United States Patent [19]

Godwin

[11] Patent Number: 4,921,302

[45] Date of Patent: May 1, 1990

[54] TABLE

[76] Inventor: William E. Godwin, 1012 - 73 Avenue SW., Calgary, Alberta, Canada, T2V 0R8

[21] Appl. No.: 371,006

[22] Filed: Jun. 26, 1989

[30] Foreign Application Priority Data

Jul. 11, 1988 [CA] Canada ..... 513598

[51] Int. Cl.[5] ..... A47B 39/00

[52] U.S. Cl. ..... 297/170; 108/1; 108/10; 297/135; 297/174

[58] Field of Search ..... 297/174, 171, 172, 135, 297/195; 108/10, 96, 106, 1, 9, 102, 106, 143; 248/419, 423

[56] References Cited

U.S. PATENT DOCUMENTS 2,732,007 1/1956 MacWhirter ..... 297/172

3,805,710 4/1974 Leshem ..... 108/6

4,506,466 3/1985 Hall ..... 297/135 X 4,798,411 1/1989 Lin ..... 297/174 X

*Primary Examiner*—James T. McCall

*Attorney, Agent, or Firm*—George H. Dunsmuir

[57] ABSTRACT

A structurally simple table and bench combination includes a rectangular planar table top pivotally connected to two pairs of legs, one pair of legs at one end of the table top being non-extensible, and the other pair of legs at the other end of the table top being extensible; and a bench defined by a pair of tubular sides extending outwardly from the non-extensible legs away from the extensible legs for receiving rods attached to the extensible legs, so that the extensible legs can be moved towards or away from the non-extensible legs while the extensible legs are retracted or extended to change the angle of inclination of the table top.

6 Claims, 2 Drawing Sheets

TABLE

BACKGROUND OF THE INVENTION

This invention relates to a combination table and bench, and in particular to a table/bench combination which can be used for drawing or drafting.

Table/bench combinations have been proposed in the past. Examples of such combinations are found in U.S. Pat. Nos. 2,271,007, which issued to F. C. Hanna on Jan. 27, 1942; 2,530,785, which issued to L. J. Rocca on Nov. 21, 1950 and 4,211,449, which issued to L. D. Richardson et al on July 8, 1980. In general, the patented devices are somewhat limited in trms of their use, or unnecessarily complicated in terms of structure. The Rocca device includes a seat which is cantilevered between a set of legs, and accordingly the Rocca structure appears to be somewhat flimsy.

The object of the present invention is to overcome the disadvantages or drawbacks of the patented devices by providing a combination table and bench which is structurally sound, and the table portion of which can readily be moved between horizontal and inclined use positions.

BRIEF SUMMARY OF THE INVENTION

Accordingly, the present invention relates to a table and bench combination comprising table top means; first leg means pivotally supporting one end of said top means; second, extensible leg means pivotally supporting the other end of said top means; bench means extending outwardly from said first leg means beneath said top means away from said second leg means; track means on said bench means; and rod means on said second leg means slidably engaging said track means, whereby said second leg means can be slid towards or away from said first leg and simultaneously extended or retracted, to move the top means between horizontal and steeply inclined use positions.

The invention will now be described in greater detail with reference to the accompanying drawings, which illustrates a preferred embodiment of the invention, and wherein.

DESCRIPTION OF THE PREFERRED EMBODIMENT(S)

Figure 1:
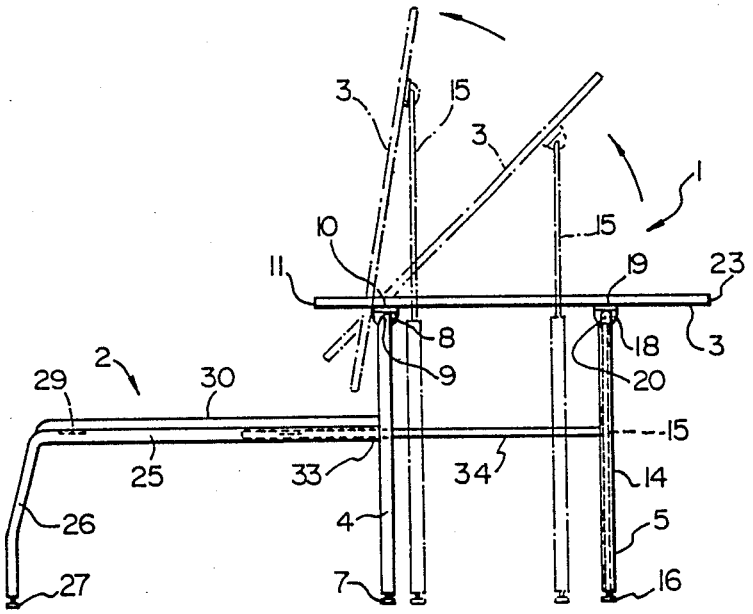
FIG. 1 is a side elevation view of a combination table and bench in accordance with the present invention.

Referring to the drawings, the combination table and bench of the present invention includes a table generally indicated at 1 and a bench generally indicated at 2. The table 1 is defined by a rectangular, planar top 3, and two pairs of legs 4 and 5. Each of the legs 4 is defined by a length of tubing, with an adjustable foot 7 in the bottom end thereof. The top end of each leg 4 is pivotally connected to a bracket 8 by a pin 9. The bracket 8 is defined by one pair of spaced apart lugs extending downwardly from a metal strip 10, which is attached to the table top 3 near one end 11 thereof. For such purpose, holes 13 for receiving screws (not shown) are provided near each end of the strip 10.

Each of the legs 5 is defined by a tubular body 14 and a rod 15 slidable therein. The inner diameter of the tube 14 and the diameter of the rod 15 are such that while the rod 15 is slidable in the tube 14, there is a friction fit between the two elements so that when the rod 15 is slid to various positions, the rod tends to stay in such positions. A foot 16 is provided on the bottom end of each leg 5. The top end of each rod 15 is pivotally connected to a lug 18 extending downwardly from a metal strip 19 by a pin 20. The strip 19 is also provided with holes 22 near the end thereof for connecting the strip to the bottom of the table top 3 near the other end 23 thereof.

The bench 2 is defined by a pair of tubular metal sides 25, which extend horizontally outwardly from the legs 4 away from the legs 5. The outer ends of the sides 25 curve downwardly to define legs 26. Feet 27 are provided at the bottom ends of the legs 26 for supporting the bench 2 in the horizontal position. Crossbars 29 extend between the sides 25 of the bench for reinforcing the latter. An elongated padded seat 30 is mounted on the top surfaces of the sides 25 and crossbars 29. Holes 32 are provided in the crossbars 29 for receiving screws (not shown) for connecting the seat 30 to the crossbars 29.

The inner end 33 of each of the sides 25 of the bench 2 is open. Thus, the sides 25 of the bench 2 act as tracks for slidably receiving rods 34 extending outwardly from the legs 5 into such sides 25. Thus, the legs 5 can be slid towards the legs 4. A handle 36 is provided on a crossbar 37 extending between the legs 5 for facilitating holding of the table end of the combination when moving the top 3 from the inclined to the vertical position. The handle 36 also makes it easier to carry the table and bench.

In use, the table top 3 can be in the horizontal position shown in solid lines in FIG. 1, or in a variety of inclined positions two of which are shown in phantom outline in FIG. 1. It will be appreciated that as the legs 5 are moved towards the legs 4, the rods 34 slide into the open ends 33 of the bench sides 25, and, at the same time, the rods 15 in the sleeves 14 slide upwardly to incline the table top 3. As the top 3 changes inclination, the lugs 8 and 18 pivot arund the pins 9 and 20.

Figure 2:
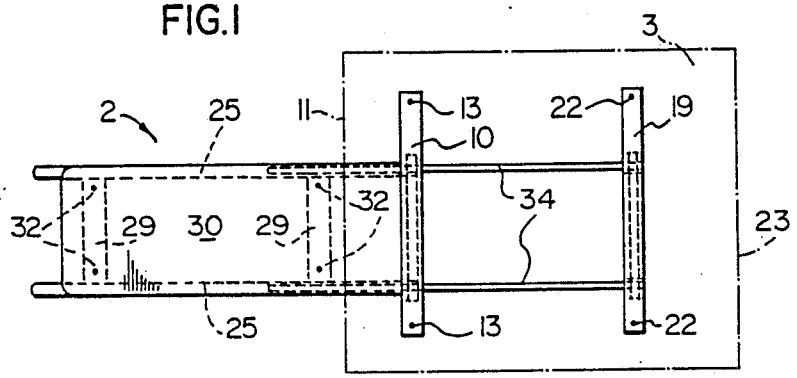
FIG. 2 is a top view of the combination of FIG. 1 with parts removed.
Figure 3:
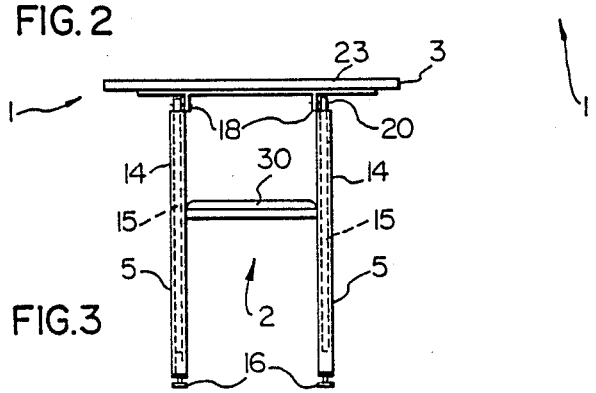
FIG. 3 is an end view of the combination of FIGS. 1 and 2.
Figure 4:
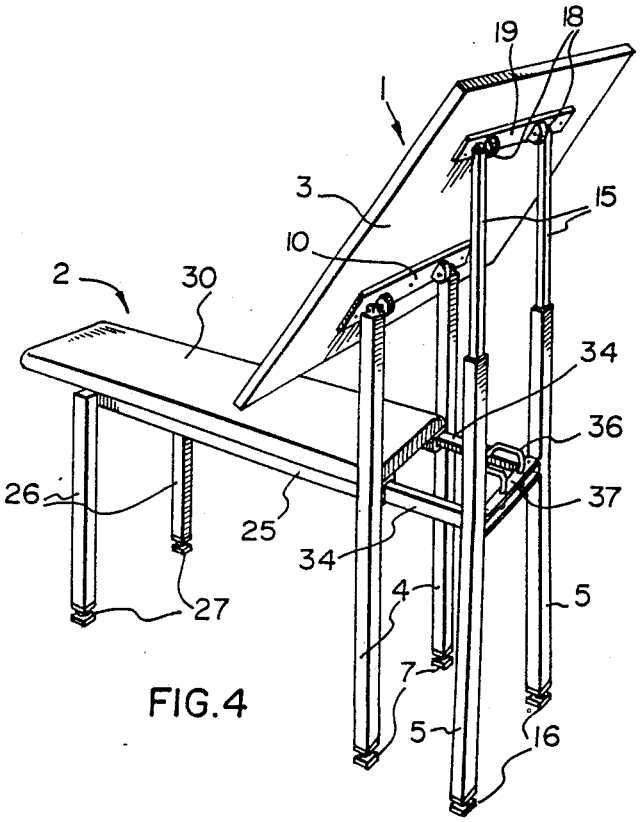
FIG. 4 is a perspective view from above and one end of a second embodiment of the table and bench combination of the present invention.
Figure 5:
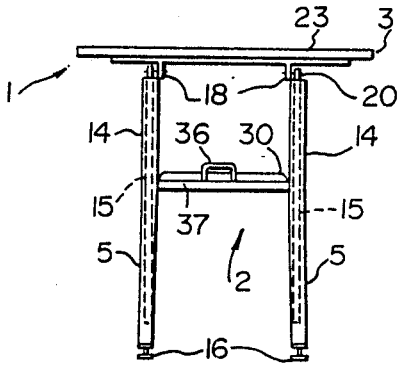
FIG. 5 is an end view of the combination of FIG. 4.

Referring to FIGS. 4 and 5, the second em bodiment of the invention is virtually identical to that of FIGS. 1 to 3, and accordingly, wherever possible the same reference numerals have been used to identify the same or similar elements.

In the second embodiment of the invention, the lower ends of the legs 5 flare downwardly which provides stability when the table top 3 is in the horizontal or slightly inclined position (up to 15°) while still permitting movement of the table top. As the table top 3 is moved towards the horizontal position, the bottom ends of the straight rods 15 engage the inner sides of the legs 5 which causes the top 3 to remain in one position. While only the rear legs 5 are shown as having sloping or inclined positions, it will be appreciated that all legs 4, 5 and 26 can be inclined to facilitate stacking of several table and bench combinations.

Figure 6:
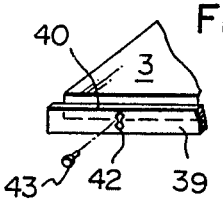
FIG. 6 is a perspective view of one corner of a table top used in the combinations of FIGS. 1 to 5.

With reference to FIG. 6, the top 3 of either embodiment of the combination table and bench can be provided with a hard plastic lip or border 39. The border is preferably formed of high density polyethylene. The top edge 40 of the border 39 is either flush with the top surface of the table top 3, or raised. In order to fix the border 39 in one of the two positions, barbell shaped slots 42 (one shown) are provided in the border for receiving pins 43 (one shown).

Thus, there has been defined a relatively simple table and bench combination which is structurally sound and easy to assemble. Moreover, the table top can be used either in a horizontal or in a variety of inclined positions.

What I claim is:

1. A table and bench combination comprising table top means; first leg means pivotally supporting one end of said top means; second, extensible leg means pivotally supporting the other end of said top means; bench means extending outwardly from said first leg means beneath said top means away from said second leg means; track means on said bench means; and rod means on said second leg means slidably engaging said track means, whereby said second leg means can be slid towards or away from said first leg and simultaneously extended or retracted, to move the top means between horizontal and steeply inclined use positions.

2. A combination according to claim 1, wherein said bench means includes a pair of parallel tubular sides, each said side having a first open end for receiving said rod means, thus defining said track means.

3. A combination according to claim 2, wherein a second, downwardly extending end on each said tubular side defines leg means for supporting the outer free end of said bench means.

4. A combination according to claim 1, wherein said first leg means includes a first pair of legs pivotally connected to one end of said top means, and said second leg means includes a second pair of extensible legs pivotally connected to the other end of said top means.

5. A combination according to claim 4, wherein each leg of said second pair of legs includes a tubular bottom portion and a rod slidable in said bottom portion; and pin means pivotally connecting a top end of said rod to said other end of said top means.

6. A combination according to claim 4, wherein said tubular bottom portion of said legs flair downwardly, whereby said rod means engages the interior of said tubular bottom portions to retain said top means in the horizontal or slightly inclined position.

* * * * *